US009000657B2

(12) United States Patent
Mitsumoto

(10) Patent No.: US 9,000,657 B2
(45) Date of Patent: Apr. 7, 2015

(54) CYCLOTRON

(71) Applicant: Sumitomo Heavy Industries, Ltd., Tokyo (JP)

(72) Inventor: Toshinori Mitsumoto, Nishitokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 172 days.

(21) Appl. No.: 14/053,734

(22) Filed: Oct. 15, 2013

(65) Prior Publication Data

US 2014/0139096 A1 May 22, 2014

(30) Foreign Application Priority Data

Nov. 20, 2012 (JP) ..... 2012-254346

(51) Int. Cl.
*H05H 13/00* (2006.01)
*H05H 7/12* (2006.01)

(52) U.S. Cl.
CPC ..... *H05H 13/005* (2013.01); *H05H 2007/122* (2013.01)

(58) Field of Classification Search
CPC ..... H05H 13/005; H05H 2007/122
USPC ..... 313/62; 315/5.41, 5.39, 111.01, 502
See application file for complete search history.

(56) References Cited

U.S. PATENT DOCUMENTS 5,227,701 A * 7/1993 McIntyre ..... 315/5.41
H001758 H * 11/1998 Malouf et al. ..... 315/5.39
6,870,320 B2 * 3/2005 Ratzinger et al. ..... 315/111.01
7,315,140 B2 * 1/2008 Sasaki et al. ..... 315/502
7,888,630 B2 * 2/2011 Wong ..... 250/251
2002/0180364 A1 * 12/2002 Ratzinger et al. ..... 315/111.01
2006/0164026 A1 * 7/2006 Sasaki et al. ..... 315/502
2007/0001128 A1 * 1/2007 Sliski et al. ..... 250/492.3
2007/0284522 A1 * 12/2007 Wong ..... 250/283
2009/0236545 A1 * 9/2009 Timmer ..... 250/492.1
2010/0045213 A1 * 2/2010 Sliski et al. ..... 315/502

FOREIGN PATENT DOCUMENTS

JP 08-166494 A 6/1996
JP 2004-031115 A 1/2004

OTHER PUBLICATIONS

European Search Report dated Feb. 24, 2014 corresponding to European Patent Application No. 13004888.7.
L.M. Onischenko et al., "Development of Compact Cyclotron for Explosives Detection by Nuclear Resonance Absorption of Gamma-Rays in Nitrogen," Proceedings of RuPAC XIX, Dubna 2004, pp. 126-128, XP002719635.
R. K. Bhandari et al., "The Beam Handling and Axial Injection System for the Project Isis at Julic," Proceedings of Cyclotrons '81, 1981, pp. 261-265, XP002719636.
P. Heikkinen et al., "Ion Optics in the Jyväskylä Cyclotron," Proceedings of Cyclotrons '92, 1992, pp. 392-395, XP002719637.
B. Gikal et al., "Recent Developments at Dubna U400 and U400M Cyclotrons," Proceedings of Cyclotrons '98, 1998, pp. 587-591, XP001719638.
R.W. Hamm et al., "Use of the Radio-Frequency Quadrupole Structure as a Cyclotron Axial Buncher System," Proceedings of Cyclotrons '81, 1981, pp. 359-363, XP002719639.

* cited by examiner

*Primary Examiner* — Thomas A Hollweg
(74) *Attorney, Agent, or Firm* — Squire Patton Boggs (US) LLP

(57) ABSTRACT

There is provided a cyclotron including: a hollow yoke; first and second poles disposed in the yoke; an ion source that generates an ion; a buncher of which at least a part enters the yoke and which adjusts a density of an ion beam, which is emitted from the ion source, in a traveling direction; and an inflector that deflects an ion beam having passed through the buncher to make the ion beam incident on a median plane.

3 Claims, 2 Drawing Sheets

CYCLOTRON

INCORPORATION BY REFERENCE

Priority is claimed to Japanese Patent Application No. 2012-254346, filed Nov. 20, 2012, the entire content of each of which is incorporated herein by reference.

BACKGROUND

1. Technical Field

The present invention relates to a cyclotron having a buncher.

2. Description of the Related Art

As a technical document regarding a cyclotron, for example, the related art is known. The related art discloses a cyclotron having an external ion source, in which a buncher is provided before a stage to make the ion beam emitted from the external ion source incident on the cyclotron center.

Such a buncher is used for efficient acceleration of the ion beam in a high-frequency electric field. That is, since the potential difference changes periodically in a high-frequency electric field, a part where the ion beam accelerates due to the potential difference in a traveling direction (phase direction) and a part where the ion beam does not accelerate occur. For this reason, a buncher that adjusts the density of ion beams in the traveling direction so that the ion beams are focused on the acceleration part is provided in order to improve the beam efficiency.

SUMMARY

According to an embodiment of the present invention, there is provided a cyclotron including: a hollow yoke; first and second poles disposed in the yoke; an ion source that generates an ion; a buncher of which at least a part enters the yoke and which adjusts a density of an ion beam, which is emitted from the ion source, in a traveling direction; and an inflector that deflects an ion beam having passed through the buncher to make the ion beam incident on a median plane.

DETAILED DESCRIPTION

Incidentally, if the density of ion beams in the traveling direction is adjusted using the buncher, the bunching effect is reduced due to repulsion by the space charge effect between the focused ions. Such a space charge effect appears stronger as the current value of the ion beam becomes higher. Since the bunching effect is reduced due to the space charge effect, there has been a problem in that the beam efficiency is reduced in the cyclotron.

Therefore, it is desirable to provide a cyclotron capable of improving the beam efficiency.

According to this cyclotron, since at least a part of the buncher enters the yoke, it is possible to reduce the distance between the buncher and the inflector, compared with a configuration in the related art in which a buncher is disposed outside a yoke. For this reason, since the ion beam can reach the inflector before the ion beam is spread by the space charge effect after adjusting the density of the ion beam in the traveling direction (phase direction) using the buncher, it is possible to accelerate the ion beam in a state having a high bunching effect. As a result, it is possible to improve the beam efficiency.

In the cyclotron according to the embodiment of the present invention, at least a part of the buncher may enter the first pole.

According to this cyclotron, since it is possible to further reduce the distance between the buncher and the inflector, the buncher and the inflector can be disposed so as to be appropriately close to each other even in the case of a large cyclotron. As a result, it is possible to improve the beam efficiency.

In the cyclotron according to the embodiment of the present invention, an electrode portion of the buncher may be located at one end on the inflector side.

According to this cyclotron, since the electrode portion that adjusts the density of the ion beam in the traveling direction is located at the end on the inflector side, the ion beam can reach the inflector before being spread by the space charge effect, compared with a case where the electrode portion is located in a portion other than the end on the inflector side. This is advantageous in improving the beam efficiency.

In the cyclotron according to the embodiment of the present invention, the yoke may include a first hole that at least a part of the buncher enters and a second hole formed so as to be approximately symmetrical with the first hole with respect to the inflector.

According to this cyclotron, compared with a case where the second hole is not provided, it is possible to maintain the symmetry of the yoke. Therefore, control of the magnetic field on the median plane becomes easy.

Hereinafter, a preferred embodiment of the present invention will be described with reference to the drawings.

Figure 1:
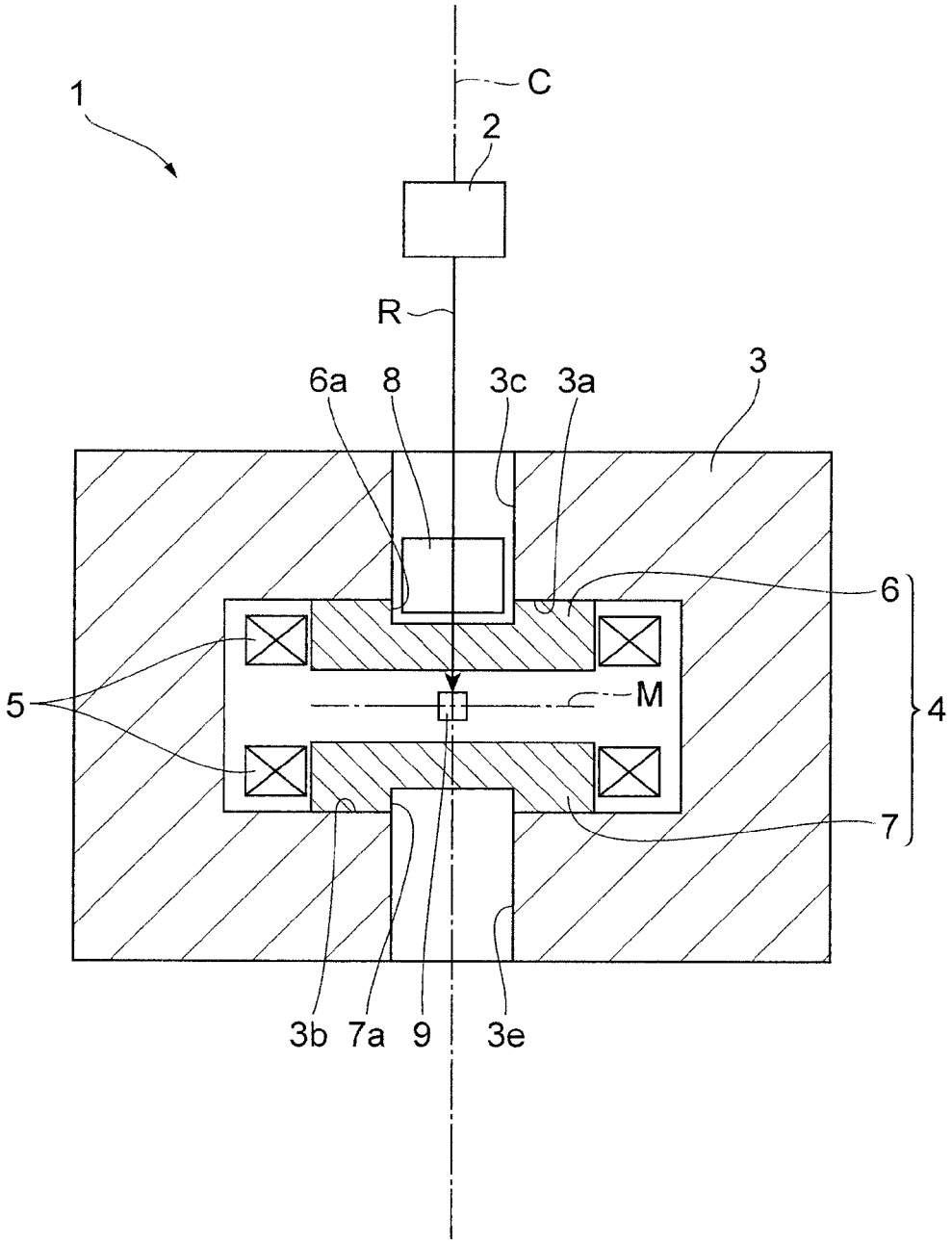
FIG. 1 is a cross-sectional view showing a cyclotron according to an embodiment of the present invention.

As shown in FIG. 1, a cyclotron 1 according to the present embodiment is a horizontal type accelerator that accelerates and emits an ion beam R emitted from an ion source 2. As ions that form the ion beam R, for example, protons, heavy ions, and the like can be mentioned.

The cyclotron 1 is used as a cyclotron for positron emission tomography (PET), a cyclotron for boron neutron capture therapy, a cyclotron for radio isotope (RI) formulation, a cyclotron for neutron sources, a cyclotron for protons, and a cyclotron for deuterons, for example.

The cyclotron 1 includes the ion source 2, a hollow yoke 3 in which predetermined space is formed, a pole 4, a coil 5, a buncher 8, and an inflector 9.

The ion source 2 is an external ion source that is provided outside the yoke 3 to generate ions. In FIG. 1, the ion source 2 is provided on the central axis C of the disc-shaped cyclotron 1. However, the ion source 2 does not necessarily need to be provided on the central axis C. The ion source 2 may be provided below the cyclotron 1 instead of being provided above the cyclotron 1. In addition, a part or the entire the ion source 2 may be provided inside the yoke 3.

The pole 4 is a pole including an upper pole (first pole) 6 and a lower pole (second pole) 7. The upper pole 6 is disposed on an upper surface 3*a* inside the yoke 3, and the lower pole 7 is disposed on a lower surface 3*b* inside the yoke 3. The annular coil 5 is disposed around the upper pole 6 and the lower pole 7, and a magnetic field in a vertical direction is generated between the upper pole 6 and the lower pole 7 by current supply to the coil 5. Between the upper pole 6 and the lower pole 7, a median plane M around which the ion beam R goes is formed.

In addition, the cyclotron 1 includes a D electrode (not shown). The D electrode is formed in a fan shape when viewed from the extending direction of the central axis C.

Inside the D electrode, a cavity penetrated in the circumferential direction of the central axis C is formed. The median plane M is located in the cavity. In the cyclotron 1, a high-frequency electric field is generated within the cavity by supplying an AC current to the D electrode, and the ion beam R is repeatedly accelerated by periodic change of the potential difference in the high-frequency electric field.

The buncher 8 is used to adjust the density of the ion beam R in the traveling direction (phase direction). The buncher 8 increases the beam efficiency of the cyclotron 1 by focusing the ion beam R at predetermined intervals in the traveling direction so as to correspond to the periodic change of the potential difference in the high-frequency electric field.

The buncher 8 is disposed in the hollow yoke 3. Specifically, the buncher 8 is disposed inside a first hole 3*c* for a buncher formed in the yoke 3. The first hole 3*c* is a through hole formed along the central axis C so as to allow communication between the space inside the yoke 3 and the outside of the yoke 3. The ion beam R emitted from the ion source 2 reaches the buncher 8 through the first hole 3*c*.

In addition, a part of the buncher 8 enters a recess 6*a* formed in the upper pole 6. That is, most of the buncher 8 is housed in the first hole 3*c* of the yoke 3, and a part of the buncher 8 (on the upper pole 6 side) enters the recess 6*a* of the upper pole 6. The recess 6*a* of the upper pole 6 is formed so as to correspond to the first hole 3*c* of the yoke 3, and is recessed downward along the central axis C.

In addition, the yoke 3 has a second hole 3*e* formed on the opposite side of the first hole 3*c* with respect to the inflector 9. The second hole 3*e* is a through hole formed so as to be approximately symmetrical with the first hole 3*c* with respect to the inflector 9. That is, in order to maintain the symmetry of the yoke 3, the second hole 3*e* is formed so as to have the same size and shape as the first hole 3*c* if possible.

Similarly, the lower pole 7 has a recess 7*a* formed so as to be approximately symmetrical with the recess 6*a* of the upper pole 6 with respect to the inflector 9. The recess 7*a* is formed so as to correspond to the second hole 3*e* of the yoke 3, and is recessed upward along the central axis C.

Figure 2:
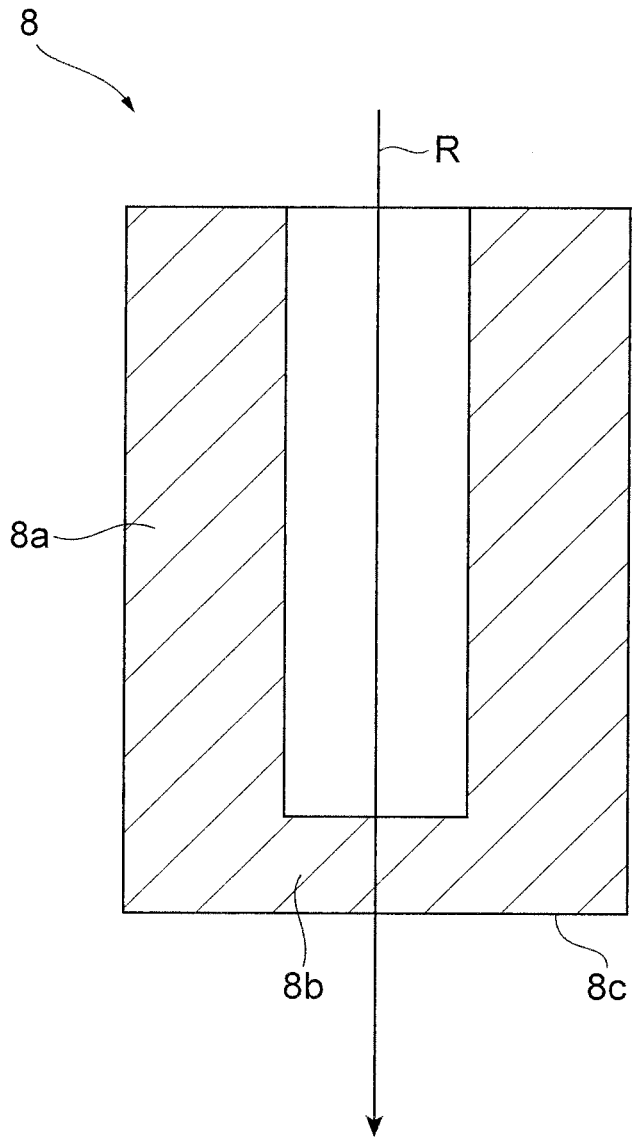
FIG. 2 is a cross-sectional view showing a buncher illustrated in FIG. 1.

FIG. 2 is a cross-sectional view showing the buncher 8. As shown in FIG. 2, the buncher 8 has a cylindrical main body portion 8*a* and an electrode portion 8*b* that closes an opening of the cylindrical main body portion 8*a* on the inflector 9 side. That is, the electrode portion 8*b* is located at the end of the buncher 8 on the inflector 9 side. The main body portion 8*a* and the electrode portion 8*b* are an integral member. For example, the main body portion 8*a* and the electrode portion 8*b* are formed of a conductive material, such as copper.

The buncher 8 is disposed at a predetermined distance from the inflector 9. Specifically, it is preferable that the buncher 8 be disposed such that the distance between an end surface 8*c* on the inflector 9 side and the inflector 9 is 10 cm to 30 cm.

The bunching effect of adjusting the density of the ion beam R before reaching the inflector 9 can be sufficiently obtained by separating the end surface 8*c* of the buncher 8 and the inflector 9 from each other by 10 cm or more. In addition, since the distance between the end surface 8*c* of the buncher 8 and the inflector 9 is less than 30 cm, it is possible to reach the inflector 9 before the bunching effect is reduced by the space charge effect.

A current is supplied from a power supply (not shown) to the buncher 8. The ion beam R travels through the inside of the cylindrical main body portion 8*a* and passes through the electrode portion 8*b*, thereby adjusting the density in the traveling direction. The ion beam R having passed through the buncher 8 travels toward the inflector 9.

In addition, the structure of the buncher 8 is not limited to that described above. For example, the electrode portion 8*b* may be provided not at the end of the main body portion 8*a* on the inflector 9 side but at the opposite end or in the middle of the main body portion 8*a*. In this case, it is preferable that the distance between the electrode portion 8*b* and the inflector 9 be 10 cm to 30 cm.

The inflector 9 is for making the ion beam R incident on (introduced to) the median plane M. A current is supplied from a power supply (not shown) to the inflector 9, and the inflector 9 deflects the ion beam R traveling along the central axis C of the cyclotron 1 to make the ion beam R incident on the median plane M. The inflector 9 is disposed approximately at the center of the cyclotron 1 between the upper pole 6 and the lower pole 7.

The ion beam R incident on the median plane M through the inflector 9 accelerates while drawing the spiral trajectory by the action of the magnetic field of the pole 4 and the electric field of the D electrode. After being sufficiently accelerated, the ion beam R is drawn from the trajectory and output to the outside.

In the cyclotron 1 according to the present embodiment described above, the buncher 8 is disposed in the yoke 3. Therefore, compared with a configuration in the related art in which the buncher 8 is provided outside the yoke 3, it is possible to reduce the distance between the buncher 8 and the inflector 9. For this reason, since the ion beam R can reach the inflector 9 before being spread by the space charge effect after adjusting the density of the ion beam R in the traveling direction (phase direction) using the buncher 8, it is possible to accelerate the ion beam R in a state having a high bunching effect. As a result, it is possible to improve the beam efficiency.

In addition, in the cyclotron 1, since apart of the buncher 8 enters the recess 6*a* of the upper pole 6, it is possible to further reduce the distance between the buncher 8 and the inflector 9. Therefore, according to the cyclotron 1, even in the case of a large cyclotron, the buncher 8 and the inflector 9 can be disposed so as to be appropriately distant from each other. As a result, it is possible to improve the beam efficiency.

In addition, according to the cyclotron 1, since the electrode portion 8*b* of the buncher 8 is located at the end of the main body portion 8*a* on the inflector 9 side, the ion beam R can reach the inflector 9 before being spread by the space charge effect, compared with a case where the electrode portion 8*b* is located in a portion other than the end on the inflector 9 side. This is advantageous in improving the beam efficiency.

In addition, in the cyclotron 1, since the second hole 3*e* formed on the opposite side of the first hole 3*c* with respect to the inflector 9 is provided, it is possible to maintain the symmetry of the yoke 3 compared with a case where the second hole 3*e* is not provided. Accordingly, control of the magnetic field on the median plane M becomes easy.

The present invention is not limited to the embodiment described above. For example, the ion beam R may be incident from the bottom side of the yoke. In this case, a buncher is disposed in a lower hole of the yoke, and enters a recess formed in the lower pole.

In addition, a buncher does not necessarily need to enter the recess formed in the upper pole or the lower pole. A buncher may be housed inside a hole formed in the yoke without reaching the upper pole or the lower pole. In addition, at least a part of the buncher may enter the yoke and the remaining portion may protrude outside the yoke.

In addition, a second hole in which a buncher is not disposed does not necessarily need to be provided in the yoke.

Similarly, a recess does not necessarily need to be provided in one of the upper pole and the lower pole that a buncher does not enter.

In addition, a vertical type cyclotron may also be adopted instead of the horizontal type cyclotron. In this case, the vertical direction in the explanation of the above embodiment becomes a horizontal direction, and the upper pole and the lower pole become a right pole and a left pole, respectively.

It should be understood that the invention is not limited to the above-described embodiment, but may be modified into various forms on the basis of the spirit of the invention. Additionally, the modifications are included in the scope of the invention.

What is claimed is:

1. A cyclotron, comprising:

a hollow yoke;

first and second poles disposed in the yoke;

an ion source that generates an ion;

a buncher of which at least a part enters the yoke and which adjusts a density of an ion beam, which is emitted from the ion source, in a traveling direction; and an inflector that deflects an ion beam having passed through the buncher to make the ion beam incident on a median plane, wherein an electrode portion of the buncher is located at one end on the inflector side.

2. The cyclotron according to claim 1, wherein at least a part of the buncher enters the first pole.

3. The cyclotron according to claim 1, wherein the yoke includes a first hole that at least a part of the buncher enters and a second hole formed so as to be approximately symmetrical with the first hole with respect to the inflector.

* * * * *